US006579060B1

(12) United States Patent
Mann, III et al.

(10) Patent No.: US 6,579,060 B1
(45) **Date of Patent: *Jun. 17, 2003**

(54) IMPELLER AND HOUSING ASSEMBLY WITH REDUCED NOISE AND IMPROVED AIRFLOW

(75) Inventors: J. Adin Mann, III, Ames, IA (US); Robert N. McKee, Aurora, OH (US); Doug S. Zlatic, North Royalton, OH (US)

(73) Assignee: Royal Appliance Mfg. Co., Glenwillow, OH (US)

( * ) Notice: Subject to any disclaimer, the term of this patent is extended or adjusted under 35 U.S.C. 154(b) by 86 days.

This patent is subject to a terminal disclaimer.

(21) Appl. No.: 09/635,091

(22) Filed: Aug. 8, 2000

Related U.S. Application Data

(63) Continuation-in-part of application No. 09/407,377, filed on Sep. 28, 1999, now Pat. No. 6,171,054.

(51) Int. Cl.[7] ..... F04D 29/42; F04D 29/66

(52) U.S. Cl. ..... 415/119; 415/204; 415/206; 415/212.1; 415/214.1; 15/326

(58) Field of Search ..... 415/119, 203, 415/204, 206, 207, 212.1, 214.1, 225, 226; 15/326, 330, 405

(56) References Cited

U.S. PATENT DOCUMENTS

| | | | | |
|---|---|---|---|---|
| 347,227 A | | 8/1886 | Campbell | |
| 3,773,432 A | | 11/1973 | Chow et al. | |
| 4,120,616 A | | 10/1978 | Dwyer et al. | |
| 4,330,899 A | | 5/1982 | Miller et al. | |
| 4,575,308 A | * | 3/1986 | Corkill | 415/206 |
| 4,864,683 A | | 9/1989 | Herron, Jr. et al. | |
| 4,884,946 A | * | 12/1989 | Belanger et al. | 415/206 |
| 4,917,572 A | * | 4/1990 | Van Houten | 415/206 |
| 5,046,922 A | * | 9/1991 | Nakamura et al. | 415/172.1 |
| 5,159,738 A | | 11/1992 | Sunagawa et al. | |
| 5,289,612 A | | 3/1994 | Glenn, III | |
| 5,293,664 A | | 3/1994 | Lim et al. | |
| 5,353,469 A | | 10/1994 | Fellhauer | |

(List continued on next page.)

FOREIGN PATENT DOCUMENTS

| | | | | |
|---|---|---|---|---|
| EP | 0081456 A1 | * | 6/1983 | 415/206 |
| EP | 0 930 040 A | | 7/1999 | |
| FR | 676564 A | * | 2/1930 | 415/204 |
| GB | 2 279 778 A | | 1/1995 | |
| JP | 58-117397 A | * | 7/1983 | 415/204 |
| SU | 1213258 A | * | 2/1986 | 415/225 |

OTHER PUBLICATIONS

Patent Abstracts of Japan 11082379 Dated Mar. 26, 1999 Showing 1 page English Abstract Only.

*Primary Examiner*—Christopher Verdier
(74) *Attorney, Agent, or Firm*—Fay, Sharpe, Fagan, Minnich & McKee, LLP

(57) ABSTRACT

An impeller and housing assembly with reduced noise and improved airflow includes a volute, a shaft, a housing, a central axis, and an inlet port located along the central axis. An outlet port is located on a second axis spaced from the central axis. An exhaust passage extends from the outlet port. The impeller is mounted on the shaft for rotation. The impeller includes a hub, and at least one blade extending from the hub. The blade has a distal surface spaced from the shaft. The impeller housing has a first plane which is approximately perpendicular to the central axis. The first plane contacts the blade distal surface. A second plane is parallel to and spaced apart from the first plane. The second plane contacts a wall of the outlet port at a location closest to the first plane. A spacing wall is positioned between the volute and the outlet port and spaces each blade from the outlet port, thus reducing noise and increasing airflow.

29 Claims, 15 Drawing Sheets

U.S. PATENT DOCUMENTS 5,400,463 A 3/1995 Attard et al.
5,511,939 A 4/1996 Tokunaga et al.
5,513,417 A 5/1996 Kim et al.
5,548,867 A 8/1996 Hwang et al.
5,573,369 A 11/1996 Du
5,588,178 A 12/1996 Liu
5,628,618 A * 5/1997 Imai et al. ..... 415/198.1
6,036,455 A * 3/2000 Ciccarelli ..... 415/206
6,171,054 B1 * 1/2001 Mann, III et al. ..... 415/204

* cited by examiner

IMPELLER AND HOUSING ASSEMBLY WITH REDUCED NOISE AND IMPROVED AIRFLOW

This application is a continuation-in-part of co-pending U.S. Pat. application Ser. No. 09/407,377 filed Sep. 28, 1999, now U.S. Pat. No. 6,171,054.

BACKGROUND OF THE INVENTION

The present invention relates to an impeller housing for a suction device. More particularly, it relates to an improved impeller housing which has reduced noise and improved airflow.

In a "dirty air" vacuum cleaner, the debris passes directly through the vacuum impeller chamber prior to being captured by the filter bag. In contrast, a "clean air" vacuum cleaner has the motor drawing the air and debris through the bag so that the bag captures the debris. The air only subsequently passes through the impeller chamber. The dirt path in a dirty air vacuum cleaner is very short compared to most clean air systems, which has advantages for cleaning performance. One disadvantage of dirty air motors is that they are typically louder than clean air motors. They also have a very loud tone noise. While not the largest contributor to the overall noise levels, the tone noise can be very annoying to consumers.

Tone noise typically occurs at a frequency that is seven times the rotation rate of the motor, which corresponds to the seven blades of the typical working fan. The motor cooling fan typically has twelve blades, is small, and may not, therefore, be a source of additional tone noise as was the case in the particular motor studied. The working fan blades cause the tone noise when they pass a geometric discontinuity in the volute shape. For example, FIG. 1 shows a cross section of the volute with the fan blades of an existing design. FIG. 1 also shows a geometric discontinuity at the motor outlet that causes tone noise. There is usually no geometric discontinuity at the motor inlet. Such discontinuities cause noise by interacting with the airflow leaving the ends of the blades. The airflow leaving the end of the blades is chopped by the discontinuities at the rate that the blades pass these discontinuities.

For noise control, there are two primary solutions. One is to isolate the noise source so that it is not heard; the other is to reduce the noise source. Isolating the noise source is an expensive choice. However, it does not require a good understanding of the noise source mechanism to be effective. The preferred solution is to reduce the source of noise.

Reducing the interaction of the airflow from the blade ends with the volute exhaust opening reduces the source of tone noise. Several ways to accomplish this are a) increasing the distance between the outer wall of the volute and the fan blade tips, b) reducing the fan rotation rate to reduce air velocity off the fan blade tips, and c) eliminating the geometric discontinuities, by moving the exhaust opening below the volute or on a different plane from the volute so that the fan blades are enclosed in a constant cross-section volute.

The first option, increasing the distance between the outer wall of the volute and the fan blade tips, has been used in several designs, but with limited success.

The second option, reducing the air velocity, reduces the noise level by approximately the velocity cubed. Reducing the air velocity would be accomplished by reducing the rpm of the motor or reducing the size of the working fan while maintaining the motor speed. Care must be taken when just reducing the size of the working fan because the motor would speed up due to the reduced load, which can result in the same velocities. If this solution were implemented, then the broadband noise would also be reduced because the broadband noise due to air turbulence decreases as the velocity decreases. However, reducing the fan rotation rate to reduce air velocity off the fan blade tips is not considered feasible because the current trend of U.S. vacuum cleaners has been to obtain as large an electrical amperage rating as possible.

Therefore, the third option, eliminating geometric discontinuities by moving the exhaust opening to below the volute or to a different plane from the volute, is the most feasible solution.

This option reduces the tone noise by removing the source of the noise. The goal is for the space around the fan tips to be in the shape of a uniform ring. Space is then provided for the air to exit behind the fan.

Accordingly, it has been considered desirable to develop a new and improved impeller housing which would overcome the foregoing difficulties and others and meet the above stated needs while providing better and more advantageous overall results.

SUMMARY OF THE INVENTION

The present invention relates to an impeller housing for a suction device. More particularly, it relates to an impeller assembly with an improved housing which has reduced noise and improved airflow.

The impeller assembly comprises a shaft and a housing. The housing comprises a plurality of walls. One of the walls comprises a volute. The plurality of walls can comprise a first wall, a second wall, a side wall connecting the first wall to the second wall, and a third wall extending from the first wall. The housing further includes a central axis, and an inlet port located along the central axis. The third wall forms an inlet passage extending from the inlet port. The shaft extends into the housing through the inlet port. The shaft is mounted along the central axis.

An outlet port is located on a second axis spaced from the central axis. An exhaust passage extends from the outlet port. The exhaust passage can increase in diameter along its length. The outlet port can be of a circular cross-section.

An impeller is mounted on the shaft for rotation. The impeller is located in the housing. The impeller includes a hub, and at least one blade extending from the hub. Each blade has a distal surface spaced from the shaft.

The impeller assembly further comprises a first plane which is approximately perpendicular to the central axis. The first plane contacts each blade distal surface. The impeller assembly also includes a second plane, parallel to and spaced apart from the first plane. The second plane contacts a wall of the outlet port at a location closest to the first plane.

The impeller blade can comprise a leading edge, a top edge and a trailing edge. The impeller can further comprise a backplate which supports the at least one blade. The backplate is positioned along the first plane.

A spacing wall is positioned between the volute and the wall of the outlet port to space each blade from the outlet port.

A top surface of the impeller can be generally parallel to a top surface of the impeller housing and the area between the top surface of the impeller and the top surface of the housing is minimized to reduce noise.

The impeller housing can include a first section and a second section to form a two-piece housing.

One advantage of the present invention is the provision of an air moving device having a new and improved impeller housing.

Another advantage of the present invention is the provision of an impeller housing with an exhaust passage which increases in diameter along its length.

Still another advantage of the present invention is the provision of an impeller housing accommodating an impeller. The blades of the impeller have a distal edge located on one side of a plane and an outlet port of the impeller housing is located on another side of the plane, thus reducing noise.

Yet another advantage of the present invention is the provision of an impeller housing in which the area between an upper surface of the impeller and an adjacent surface of the impeller housing is minimized to reduce noise.

Still yet another advantage of the present invention is the provision of an impeller housing with a spacing wall which is positioned between a volute of the housing and the outlet port of the housing to space the impeller blades from the outlet port thus reducing noise.

Still other benefits and advantages of the present invention will become apparent to those skilled in the art upon a reading and understanding of the following detailed specification.

BRIEF DESCRIPTION OF THE DRAWINGS

The invention may take form in certain parts and arrangements of parts, preferred embodiments of which will be described in detail in this specification and illustrated in the accompanying drawings which form a part hereof and wherein.

DETAILED DESCRIPTION OF THE PREFERRED EMBODIMENTS

Figure 1:
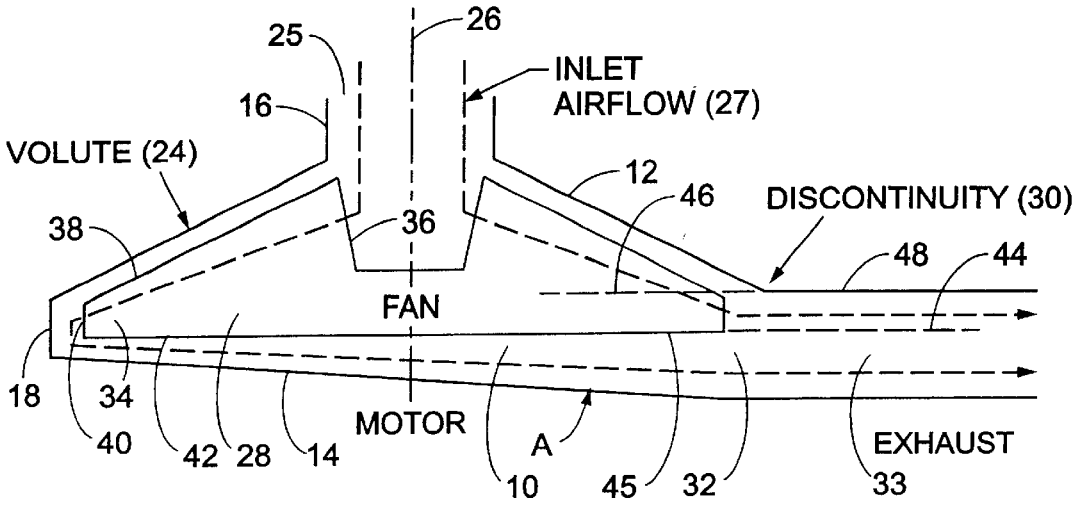
FIG. 1 PRIOR ART
FIG. 1 is a schematic side elevational view in cross-section of a prior art impeller housing having a discontinuity.

Referring now to the drawings, wherein the showings are for purposes of illustrating preferred embodiments of this invention only, and not for purposes of limiting same, FIG. 1 shows a schematic cross section of a known impeller housing and its fan blades. Such a fan design is used for vacuum cleaners, carpet extractors, leaf blowers, hair dryers, convection ovens, stove top vents, HVAC (Heating Ventilation and Air Conditioning) systems and generally any type of system which employs a fan mounted in a housing to move air. All such known systems have a geometric discontinuity in volute shape causing noise.

More specifically, referring to FIG. 1, the known impeller assembly A comprises a housing 10 which has a first wall 12, a second wall 14, a third wall 16, and a side wall 18 which connects the first wall 12 to the second wall 14. The first wall 12 forms a volute 24.

The third wall 16 extends away from the first wall 12. The third wall 16 forms the inlet passage of the volute and defines an inlet port 25. The housing 10 further comprises a central axis 26. The inlet port 25 is located along the central axis 26.

Inlet airflow 27 enters the housing through the inlet port 25. The inlet airflow 27 then is moved by a rotating impeller 28 and passes over a discontinuity 30 formed in the first wall 12 to an outlet port 32. An exhaust passage 33 extends away from the outlet port 32.

The air passes over at least one blade 34 of the impeller 28. The blade 34 has a leading edge 36, a top edge 38, and a trailing edge 40. The inlet airflow 27 passes by the leading edge 36, and between the blades 34 past the trailing edge 40 of the blades 34. The airflow 27 then is expelled into the outlet port 32 and through the exhaust passage 33. The impeller 28 further comprises a backplate 42 which supports the set of blades 34. The backplate 42 is positioned along a first plane 44 which is approximately perpendicular to the central axis 26.

The first plane 44 contacts a distal surface 45 of each blade 34. A second plane 46 is parallel to and spaced from the first plane 44. The second plane 46 contacts a wall 48 of the outlet port 32. The first plane 44 extends into the outlet port 32 such that the blade distal surface 45 is positioned below the outlet port wall 48. That is, the blade distal surface is in the plane of the outlet port 32 opening. Thus, since the blade 34 is aligned with the outlet port 32 opening, the airflow passes from the end of the blades through the discontinuity 30. The airflow is then chopped by the discontinuity 30 at the rate that the set of blades 34 pass the discontinuity 30, thus causing noise.

To eliminate the geometric discontinuity in this known design, the exhaust opening must be moved below the fan blades or on a different plane from the fan blades. The resulting airflow would then be similar to a clean air motor where the air flows off the end of the fan blades into a volume below the fan. The air is then collected in a channel and exhausted.

Figure 2:
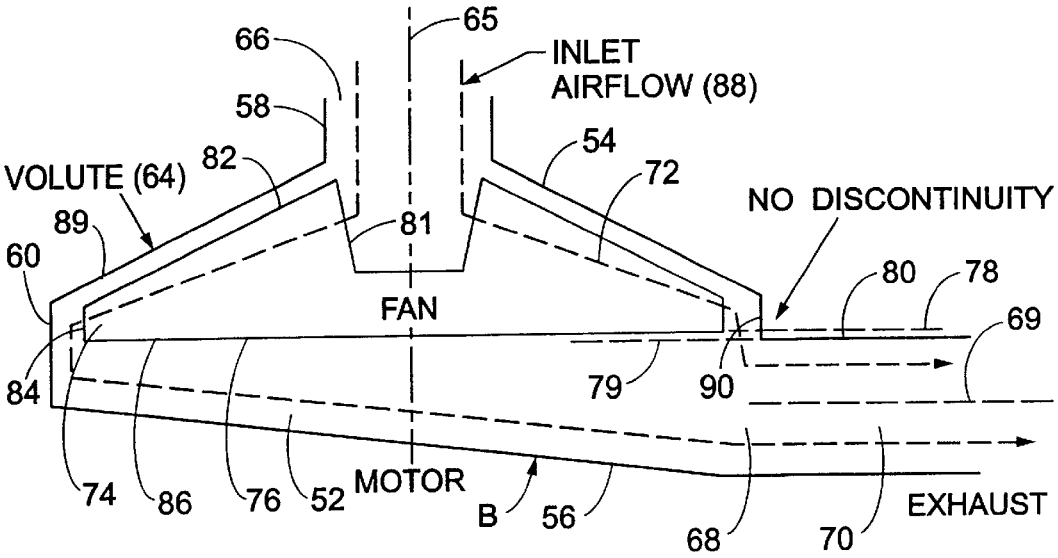
FIG. 2 is a schematic side elevational view in cross-section of an impeller housing in accordance with a first preferred embodiment of the present invention.

With reference now to FIG. 2, an impeller assembly B with an improved impeller housing which eliminates a discontinuity is shown. The impeller assembly B comprises a shaft So (shown in FIG. 3) and a housing 52. The housing 52 comprises a first wall 54, a second wall 56, a third wall 58 and a side wall 60. The side wall 60 connects the first wall 54 to the second wall 56. The third wall 58 extends away from the first wall 54. The first wall 54 forms a volute 64.

The impeller housing also comprises a central axis 65. An inlet port 66 is located along the central axis 65. The third wall 58 forms the inlet passage and defines the inlet port 66. The shaft 50 extends into the housing 52 through the inlet port 66. The shaft 50 is mounted along the central axis 65.

Figure 4:
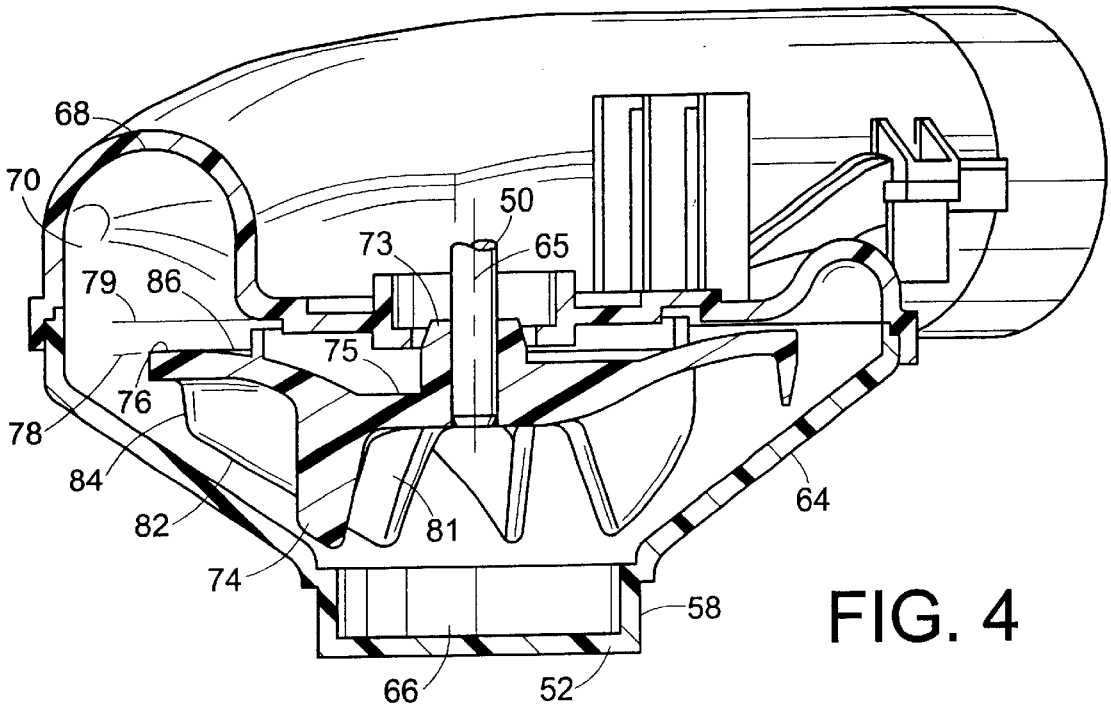
FIG. 4 is a cross-sectional view of the impeller housing of FIG. 3 along line 4—4.
Figure 5:
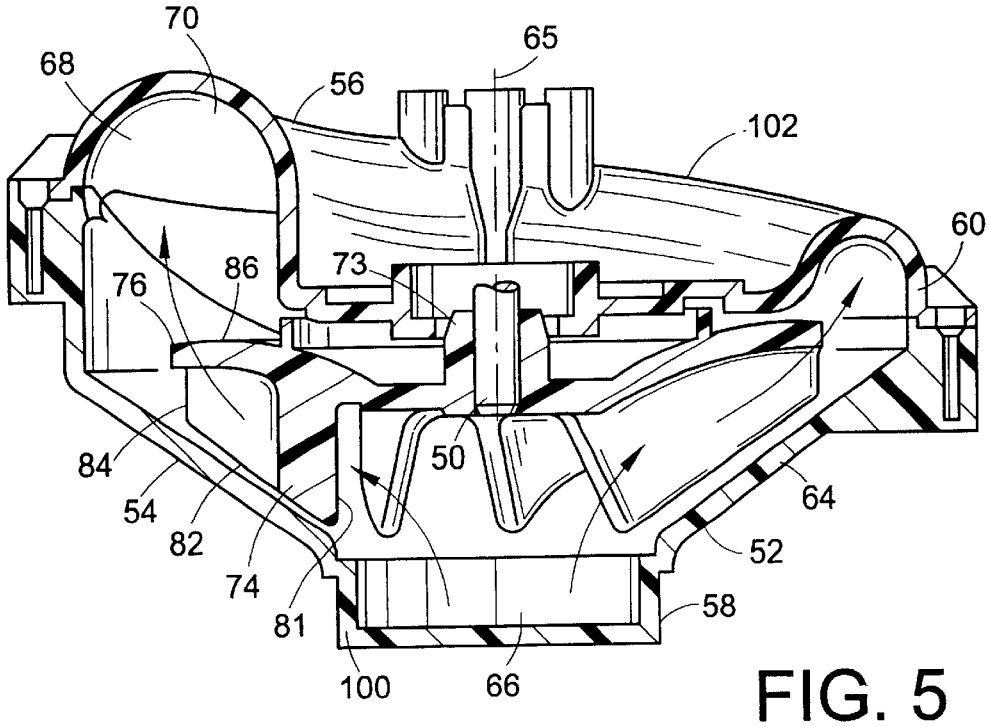
FIG. 5 is a cross-sectional view of the impeller housing of FIG. 3 along line 5—5.
Figure 6:
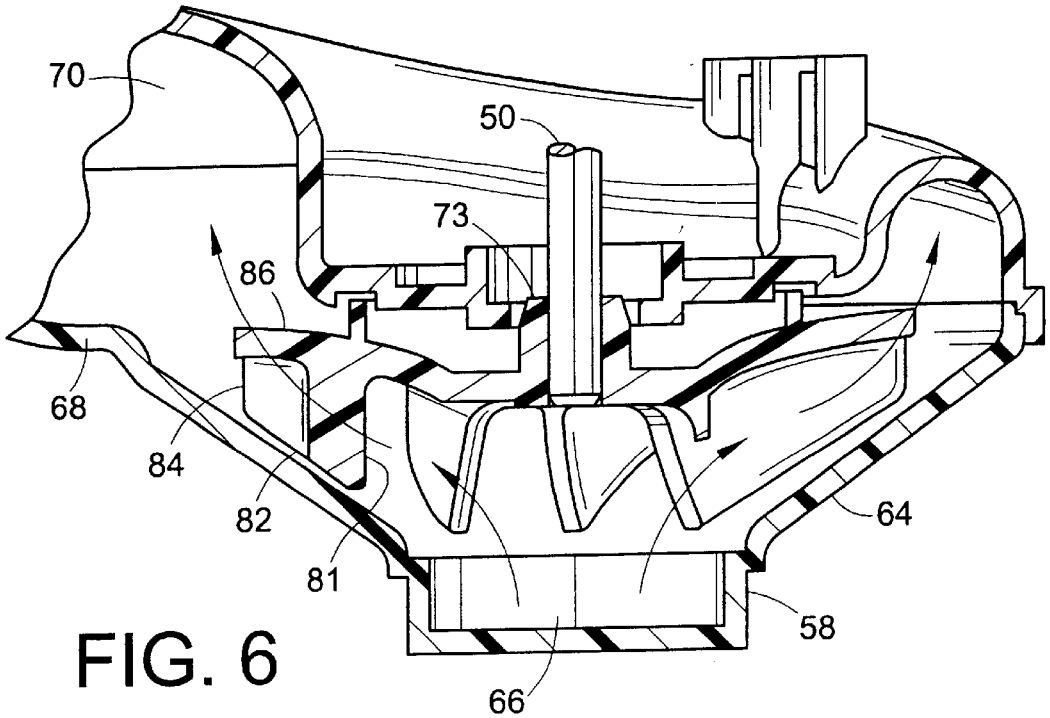
FIG. 6 is a cross-sectional view of the impeller housing of FIG. 3 along line 6—6.
Figure 7:
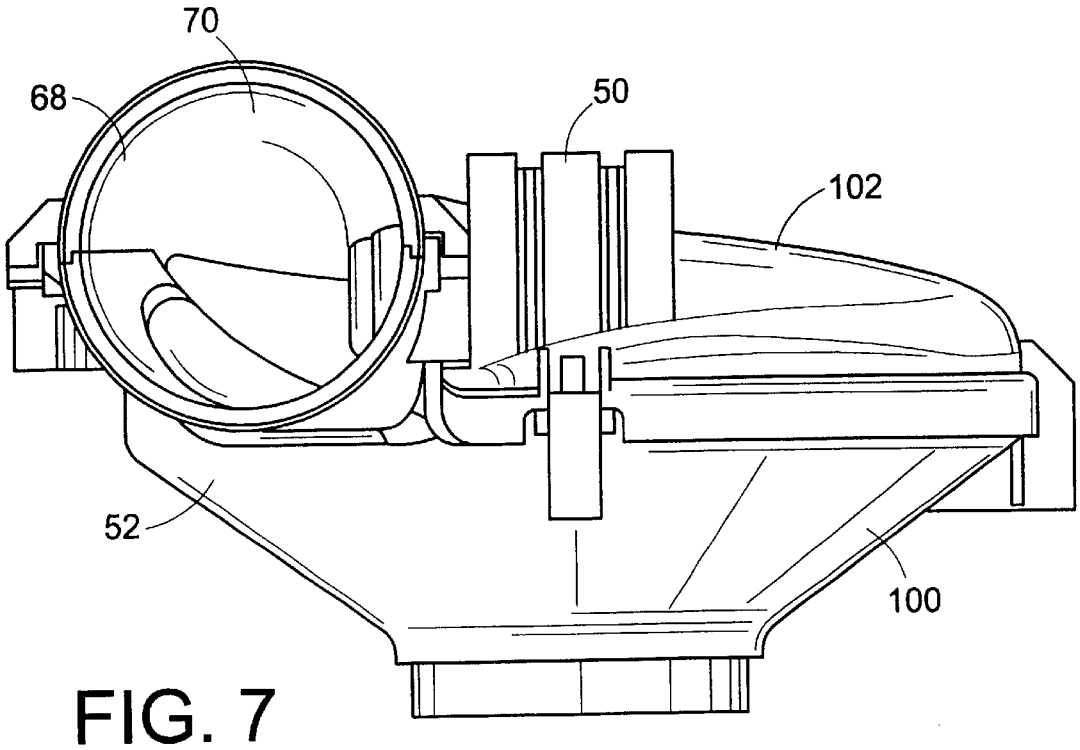
FIG. 7 is a side elevational view of the impeller housing of FIG. 3.

An outlet port 68 is located on a second axis 69 spaced from and approximately normal to the central axis 65. An exhaust passage 70 extends away from the outlet port 68. If desired, the exhaust passage 70 can increase in diameter along its length. The exhaust passage 70 can be enlarged to handle an increased air flow. FIGS. 4, 5 and 6 show the exhaust passage 70 diameter increasing along the passage length at different cross sections of the exhaust passage 70. Referring to FIG. 7, the outlet port 68 can be of a circular cross section in lieu of a rectangular cross section which is used in existing impeller housings.

Referring again to FIG. 2, an impeller 72 is mounted on the shaft 50 for rotation. The impeller 72, which is located within the housing 52, comprises a hub 73 (shown in FIGS. 4, 5, and 6) and at least one blade 74 which extends from the hub 73 along a flange 75. Preferably, a plurality of blades are used. Each blade 74 has a distal surface 76 which is spaced from the shaft 50.

The volute 64 can have a uniform cross section. Each blade 74 is enclosed within the cross section of the volute 64. The uniform cross section of the volute 64 helps to reduce noise by eliminating discontinuity along the blade length.

The impeller assembly further comprises a first plane 78 which is approximately perpendicular to the central axis 65. The first plane 78 contacts the blade distal surface 76.

The impeller assembly also comprises a second plane 79 which is parallel to and spaced from the first plane 78. The second plane 79 contacts a wall 80 of the outlet port 68 at a location which is closest to the first plane 78.

The blade 74 comprises a leading edge 81, a top edge 82, and a trailing edge 84. A backplate 86, which supports the blade 74, is positioned along the first plane 78.

Preferably, the top edge 82 of the impeller is generally parallel to a top surface 89 of the impeller housing. The area between them is preferably minimized to further reduce noise.

The impeller 72 creates an air flow (illustrated by dotted line 88 in FIG. 2) drawing air through the inlet port 66. The airflow 88 passes by the leading edge 81, and between the blades 74 past the trailing edge 84 of the blades 74. The airflow 88 then is expelled through the outlet port 68 and into the exhaust passage 70 during rotation of the impeller 72.

The impeller assembly also comprises a spacer wall 90 which is positioned between the volute 64 and the wall 80 of the outlet port 68. The spacer wall 90 spaces the trailing edge 84 of each blade 74 from the outlet port 68 and helps eliminate any discontinuity between the volute 64 and the outlet port 68.

Figure 3:
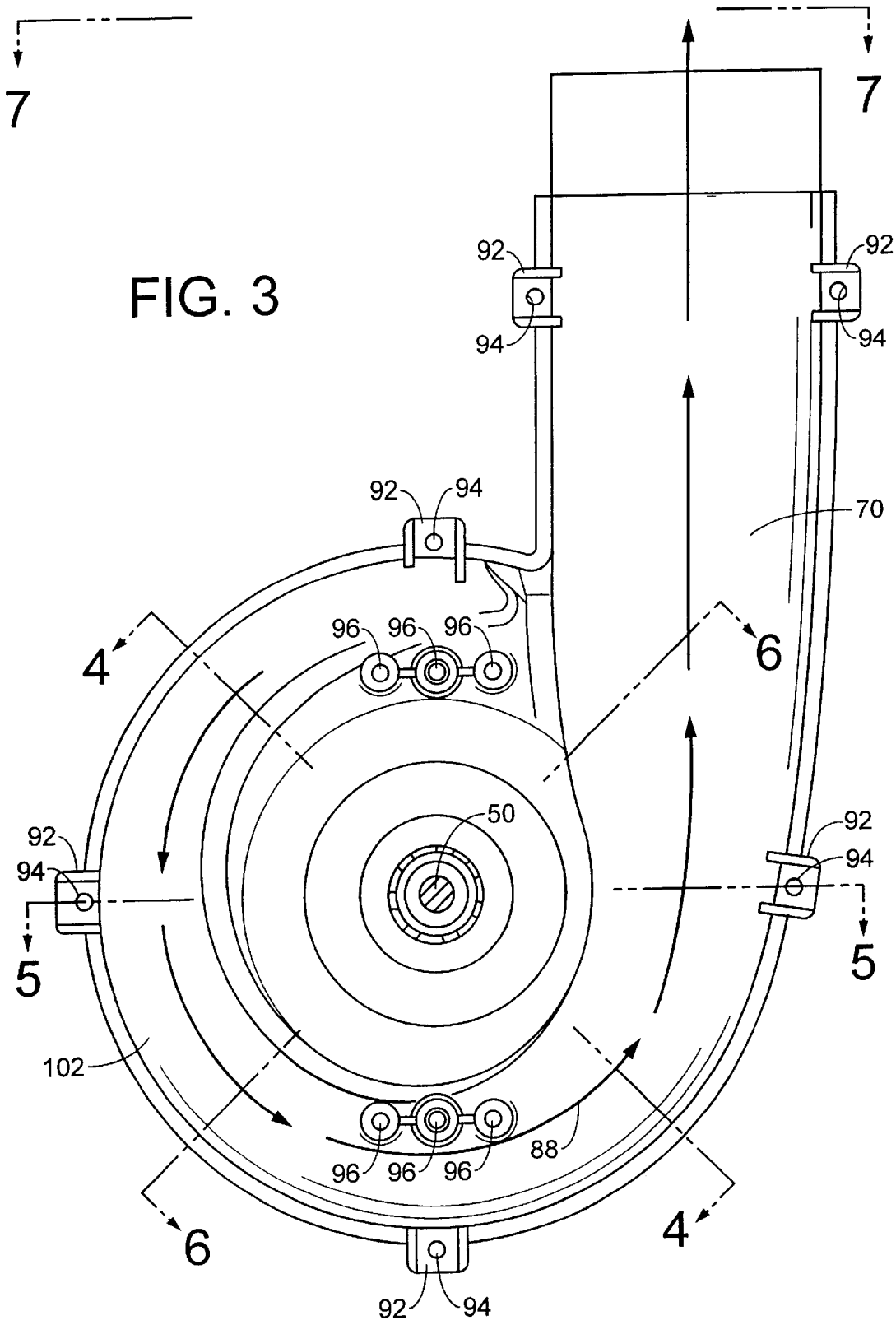
FIG. 3 is a top plan view of a prototype impeller housing according to the first preferred embodiment of FIG. 2.

Referring to FIGS. 3 and 7, in one preferred embodiment, the impeller assembly comprises a two-piece housing including a first section 100 and a second section 102. Referring to FIG. 3, the first section 100 and second section 102 each have one or more aligned flanges 92. The flanges 92 are spaced from each other. The flanges 92 each have aligned holes 94 for mounting the first section 100 to the second section 102. Additional holes 96 can also be provided for mounting the housing to the body of a vacuum cleaner or similar suction device.

Referring to FIG. 5, the first section 100 comprises the first and third walls 54, 58, a portion of the side wall 60, the inlet port 66 and a portion of the outlet port 68. The second section 102 comprises the remaining portion of the side wall 60, the second wall 56, and the remaining portion of the outlet port 68.

Another means to reduce noise created by an impeller is to reduce the rotation rate of the motor. In order to maintain the same airflow, the diameter of the impeller and the efficiency of the volute to deliver the air to the fan must be increased. Therefore, the impeller diameter has been increased by approximately 6%, the inlet area by approximately 12%, and the exhaust area by approximately 38% compared to the existing design.

The housing illustrated in FIGS. 3–7 was evaluated in a series of tests. But first, the noise radiated by the motors alone and the air performance was measured. The old motor was operated at approximately 24,000 rpm and the new motor was operated at approximately 22,500 rpm.

Figure 8:
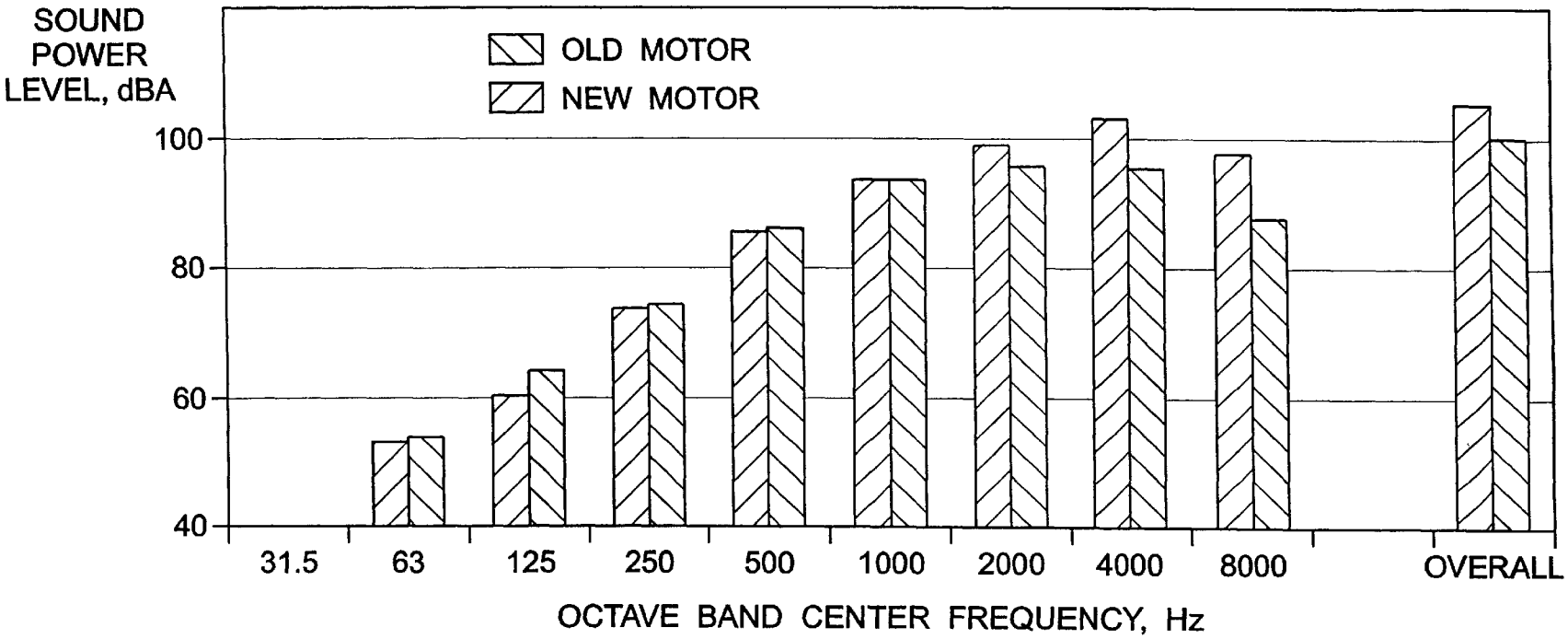
FIG. 8 is a chart comparing sound power level to octave band center frequency for the old motor in the impeller housing of FIG. 1 and new motor in the impeller housing of FIG. 2.

Then the respective motors were placed in the known impeller housing of FIG. 1 and the inventive impeller housing of FIGS. 3–7. The A-weighted octave band and overall sound power levels of the old and new motors and volutes alone in comparison with octave band center frequency are shown in FIG. 8. The average sound spectra of the two volute designs are shown in FIG. 9.

Figure 9:
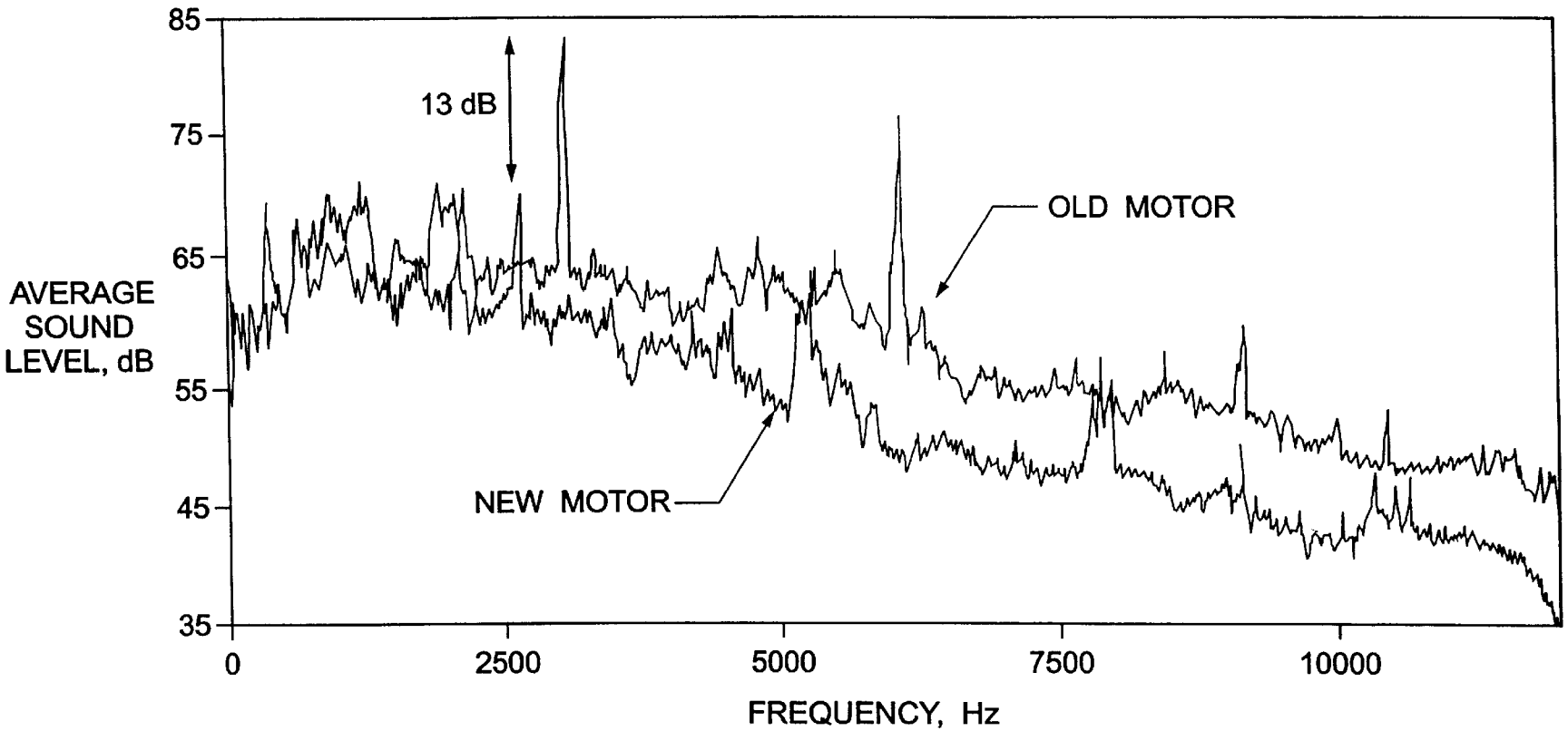
FIG. 9 is a chart comparing average sound level to frequency for the old motor and the new motor.

Referring to FIGS. 8 and 9, the new motor and impeller housing design creates broadband and tone noise reduction. The overall noise reduction is 5.5 dBA. The 2000 Hz, 4000 Hz, and 8000 Hz octave bands are all reduced. The broadband noise reduction and the 13 dB reduction in the fundamental tone are seen in FIG. 9. Only the noise in the low octave bands, 500 Hz and below, is increased with the new motor and impeller housing design. These octave bands are low compared to the octave bands where significant noise reduction was found, so these increases are not significant for the overall sound power level.

Tone noise reduction was expected with the new volute design, but broadband noise reduction was not expected. Broadband noise is generally caused by turbulence. Therefore, the new volute design allows air to flow through the volute with less turbulence. Since turbulence also decreases the efficiency of the fan, this reduction should also be reflected in the air performance.

Figure 10:
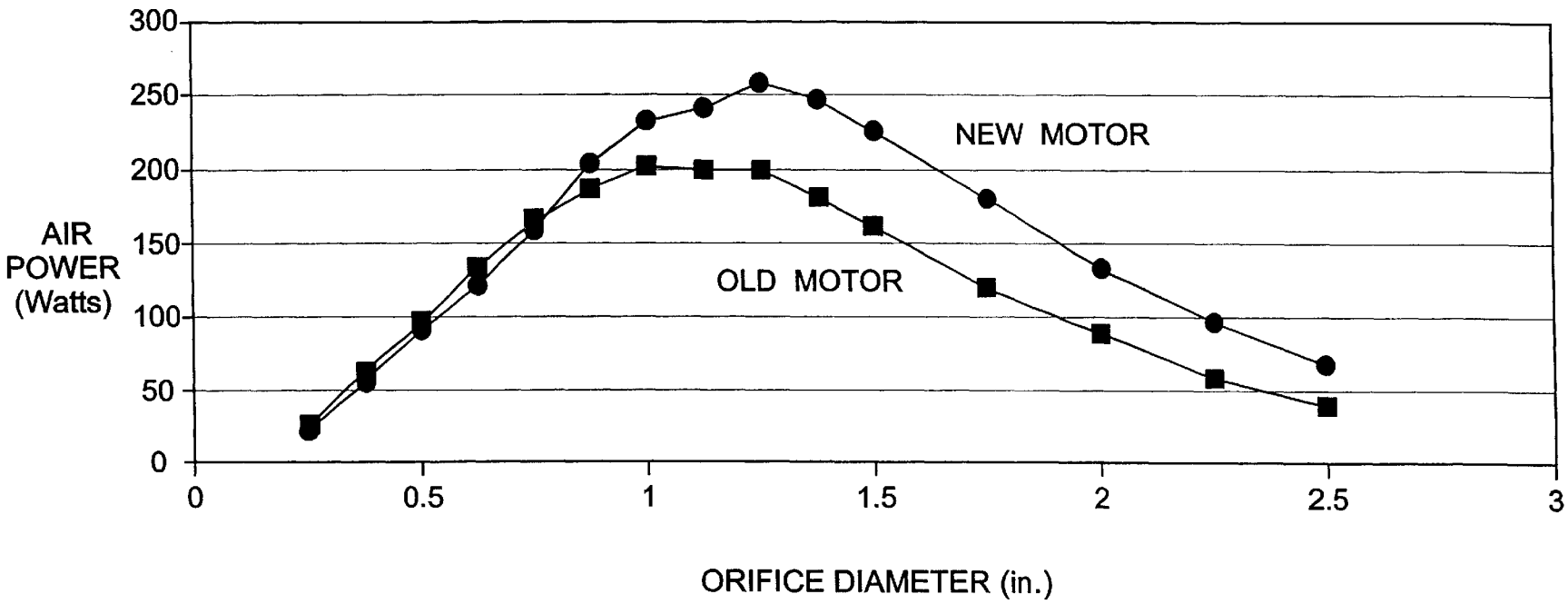
FIG. 10 is a chart comparing air power to orifice diameter for the old motor and the new motor.

The air power delivered by the new and old motor and impeller housing designs alone in comparison to the orifice diameter is shown in FIG. 10. Only the air power is shown because it is a good summary of the air performance and similar differences are seen in all the air performance parameters. The air power delivered by the new design has a peak that occurs at a larger orifice than the old design and the peak power increases by approximately 27%. This occurs with an approximate 6% rotation rate reduction.

The broadband noise reduction would initially appear to be a result of the volute and impeller moving less air. However, the increased air power along with the reduced broadband noise indicates that the new volute and fan are able to deliver more air because of a significant decrease in turbulence. Thus, turbulence, which decreases the efficiency for the motor to deliver air, is also a cause of noise. Therefore, improving airflow can be coupled with noise reduction because the noise causing mechanism is often also degrading performance.

During testing, an earlier version of the motor modification was placed inside a full vacuum cleaner. The noise reduction caused by the new motor and impeller housing design decreased from 7.8 dBA with the motor alone to 1.4 dBA overall in the vacuum cleaner. The tone noise reduction reduced from 10.7 dB with the motor and impeller housing alone to 5.7 dB in the vacuum cleaner. The measurements were performed without the brushroll operating, so the variation in noise reduction was due to the changes in airflow in the unit with and without the motor and impeller housing modification. The decreased noise reduction with the new motor and impeller housing in the vacuum cleaner indicates that the air path in the vacuum cleaner significantly negated the noise reduction that was obtained with the motor and impeller housing alone.

One hypothesis was that the lower noise reduction was caused by the back pressure on the motor created by the exhaust air path from the motor through the bag of the vacuum cleaner. This back pressure caused the air turbulence from the fan blades to interact with the volute exhaust despite the new volute geometry. Therefore, the air delivery system in the vacuum cleaner had to be redesigned to obtain the same amount of noise reduction as obtained by the motor and housing alone.

A new air delivery system was designed which allowed a greater airflow to match the increased airflow delivered by the new motor. The design steps focused on reducing the head losses throughout the air delivery system. The duct geometry, sharp bends, and the geometry of the bag cover caused significant head losses. Changes were made to the air delivery system and implemented on a prototype. To date, the prototype was constructed to test the air performance of the new air delivery system.

Figure 11:
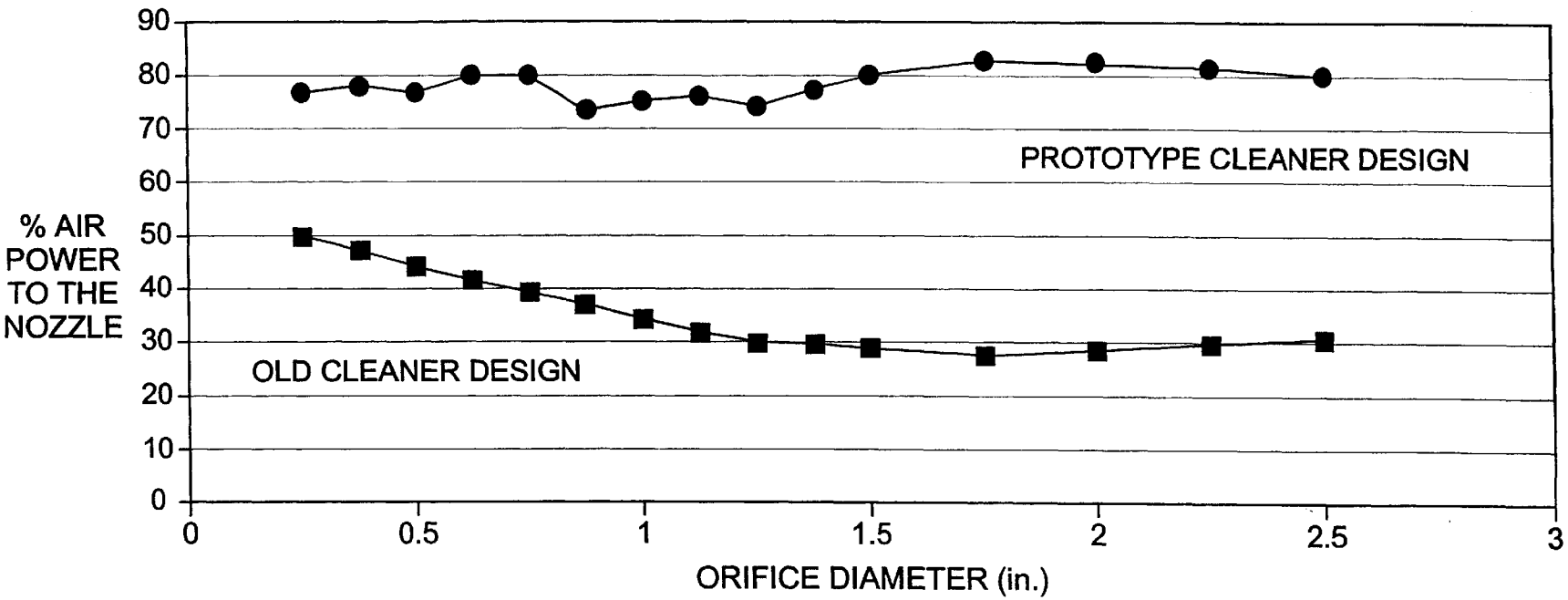
FIG. 11 is a chart comparing percent air power to a nozzle and orifice diameter for an old cleaner design and the prototype cleaner design of FIG. 3.

FIG. 11 shows a comparison of the percentage of air power delivered to the floor by the old vacuum cleaner of FIG. 1 and the prototype cleaner employing the motor and housing assembly of FIGS. 3–7. The data represents the air power at the floor with the full unit compared to the air power delivered by the motor alone. With the new air delivery system, the prototype delivers approximately 80% of the air power at the motor to the floor, compared to 35% to 40% by the old design. This significant increase in efficiency results in a lower back pressure on the new motor. The tone noise reduction is still present on the prototype.

One of the primary conclusions is that the mechanism which causes noise in the fan and volute also degrades the air performance. Thus, by removing the exhaust from the path of the fan blade tips both noise reduction and increased air performance can be obtained simultaneously. The improved impeller housing discussed above and shown in FIGS. 2–7 solves the problem by eliminating any geometric discontinuity by moving the exhaust opening to a plane spaced from the plane of the volute and the impeller.

Figure 12:
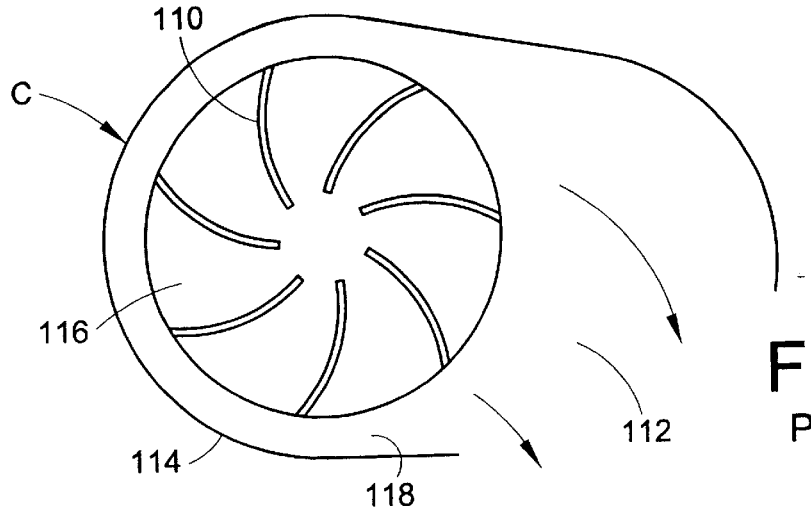
FIG. 12 PRIOR ART
FIG. 12 is a schematic top plan view of another prior art impeller housing.

FIG. 12 shows a prior art impeller assembly C for a carpet extractor. The primary noise problem with the prior art impeller assembly is a loud tone noise. This is caused by air leaving the tip of an impeller blade 110 and being chopped by an opening 112 in a volute 114 which encloses an impeller 116. The chopping occurs when the blade 110 passes an opening edge or discontinuity 118, thus causing the tone noise at the rotation rate of the impeller 116 times the number of blades 110.

Figure 13:
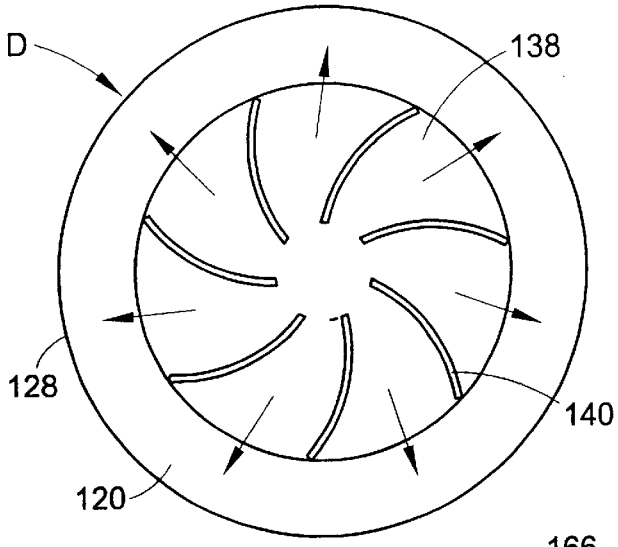
FIG. 13 is a schematic top plan view of an impeller housing in accordance with a second preferred embodiment of the present invention.
Figure 14:
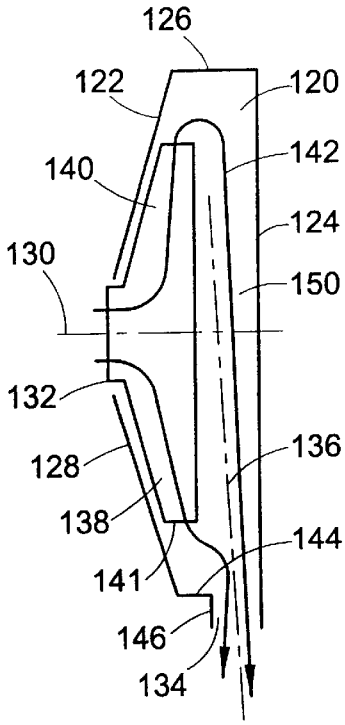
FIG. 14 is a schematic side elevational view in cross-section of the proposed impeller housing of FIG. 13.

A second preferred embodiment of the present invention is shown in FIG. 13 and FIG. 14 in the form of an impeller assembly D This design eliminates any discontinuity, thus reducing tone noise. The impeller assembly D comprises a housing 120. The housing 120 comprises a first wall 122, a second wall 124, and a side wall 126. The side wall 126 connects the first wall 122 to the second wall 124. The first wall 122 forms a volute 128.

The impeller housing comprises a central axis 130. An inlet port 132 is located along the central axis 130. An outlet port 134 is located on a second axis 136 spaced from, and approximately normal to, the central axis 130. An impeller 138 is mounted within the housing 120. The impeller comprises at least one blade 140. The impeller 138 creates an airflow (illustrated by line 142) drawing air through the inlet port 132. The airflow 142 passes through the blades 140 past a trailing edge 141 of the blades 140. The airflow 142 is expelled through the outlet port 134.

The impeller assembly also comprises a spacer wall 144 which is positioned between the volute 128 and a wall 146 of the outlet port 134. The spacer wall 144 spaces the blade 140 from the outlet port 134 and helps eliminate any discontinuity between the volute 128 and the outlet port 134.

Thus, the improved impeller assembly D reduces the tone noise by removing the source of the noise. This is accomplished by providing a space around the impeller blades 140 which is in the shape of a uniform ring. As shown in FIG. 13, the volute 128 forms the uniform ring around the impeller 138. Referring to FIG. 14, the air exhausts to an area 150 below the impeller 138 then out of the volute 128 through the outlet port 134. There is no discontinuity at the outlet port as is shown in FIG. 12 for the prior art housing (edge 118).

Figure 15:
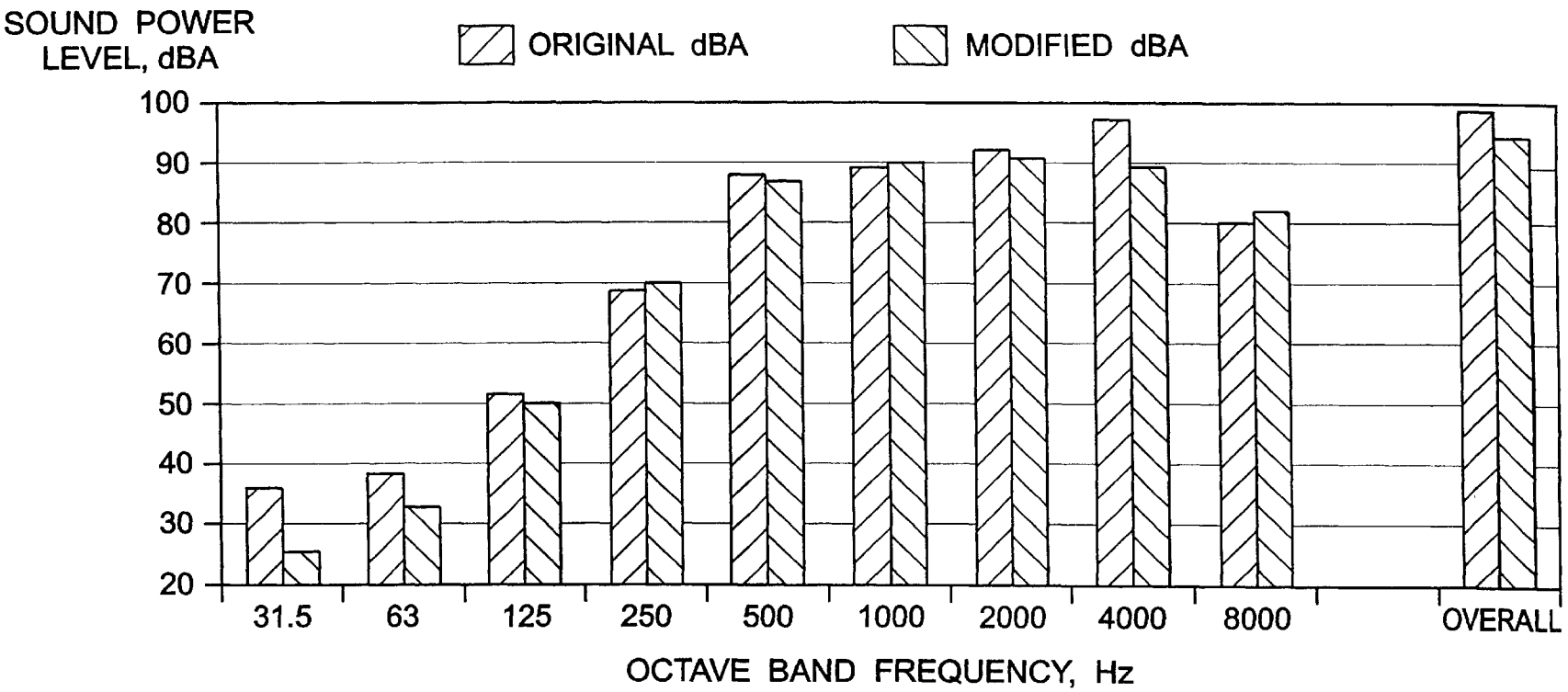
FIG. 15 is a chart comparing sound power loudness against octave band frequency of the FIG. 12 design and the FIG. 13 design.

FIG. 15 shows the sound power levels of the old motor and volute assembly of FIG. 12 and the improved motor and volute assembly of FIGS. 13 and 14 in comparison with octave band frequency. The sound power of the impeller was measured according to the ASTM F1334-97 test method. In all the measurements, a one-quarter inch ACO Pacific type 4012 microphone was used. The signal from the microphone was amplified by a Rockland series 2000 low-pass filter. The amplified signal was input to a National Instruments model AT-A2150C data acquisition card installed in a PC computer. The data acquisition was controlled with a Labview program, which output the measured sound pressure spectrum. The octave band and overall sound power levels were calculated from the sound pressure spectra.

The air performance was measured with an automated plenum chamber operated according to the ASTM F558-95 test procedure. The measured parameter was the pressure inside the plenum from which the airflow volume velocity and the air power were calculated. Measurements were made with several inlet orifice diameters for the plenum chamber. Thus, the volume, velocity and suction were output as a function of inlet orifice.

Figure 16:
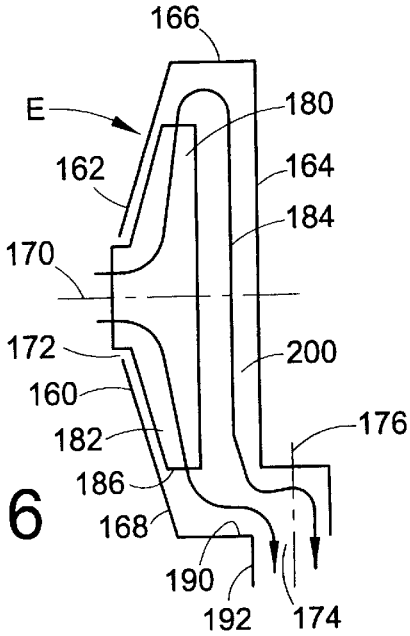
FIG. 16 is a schematic side elevational view in cross-section of an impeller housing as implemented in a prototype according to a third preferred embodiment of the present invention.

A third preferred embodiment of the present invention is shown in FIG. 16. FIG. 16 shows the implementation of the noise reduction solution in a prototype impeller assembly E for a carpet extractor. In the prototype, the brushroll motor and the pump of the carpet extractor were removed to allow room for the lower portion of the impeller housing. Airflow was reduced due to a smaller exhaust area. Referring to FIG. 16, the impeller assembly E comprises a housing 160. The housing 160 comprises a first wall 162, a second wall 164, and a side wall 166. The side wall 166 connects the first wall 162 to the second wall 164. The first wall 162 forms a volute 168.

The impeller housing comprises a central axis 170. An inlet port 172 is located along the central axis 170. An outlet port 174 is located on a second axis 176 spaced from, and approximately normal to, the central axis 170.

An impeller 180 is mounted within the housing 160. The impeller 180 comprises at least one blade 182. The impeller 180 creates an airflow (illustrated by line 184) drawing air through the inlet port 172. The airflow 184 passes through the blades 182 and past a trailing edge 186 of the blades 182. The airflow 184 is expelled through the outlet port 174.

The impeller assembly also comprises a spacer wall 190 which is positioned between the volute 168 and a wall 192 of the outlet port 174. The spacer wall 190 spaces the blade 182 from the outlet port 174 and helps eliminate any discontinuity between the volute 168 and the outlet port 174. As shown in FIG. 16, the outlet port 174 is positioned below the impeller 180 within the volute 168. An exhaust area 200 is reduced in size below the impeller 180 compared to the exhaust area 150 of the impeller assembly of FIG. 14. This is due to space limitations within the prototype. There is no discontinuity at the outlet port 174 as is shown in FIG. 12 for the prior art housing (edge 118).

Figure 17:
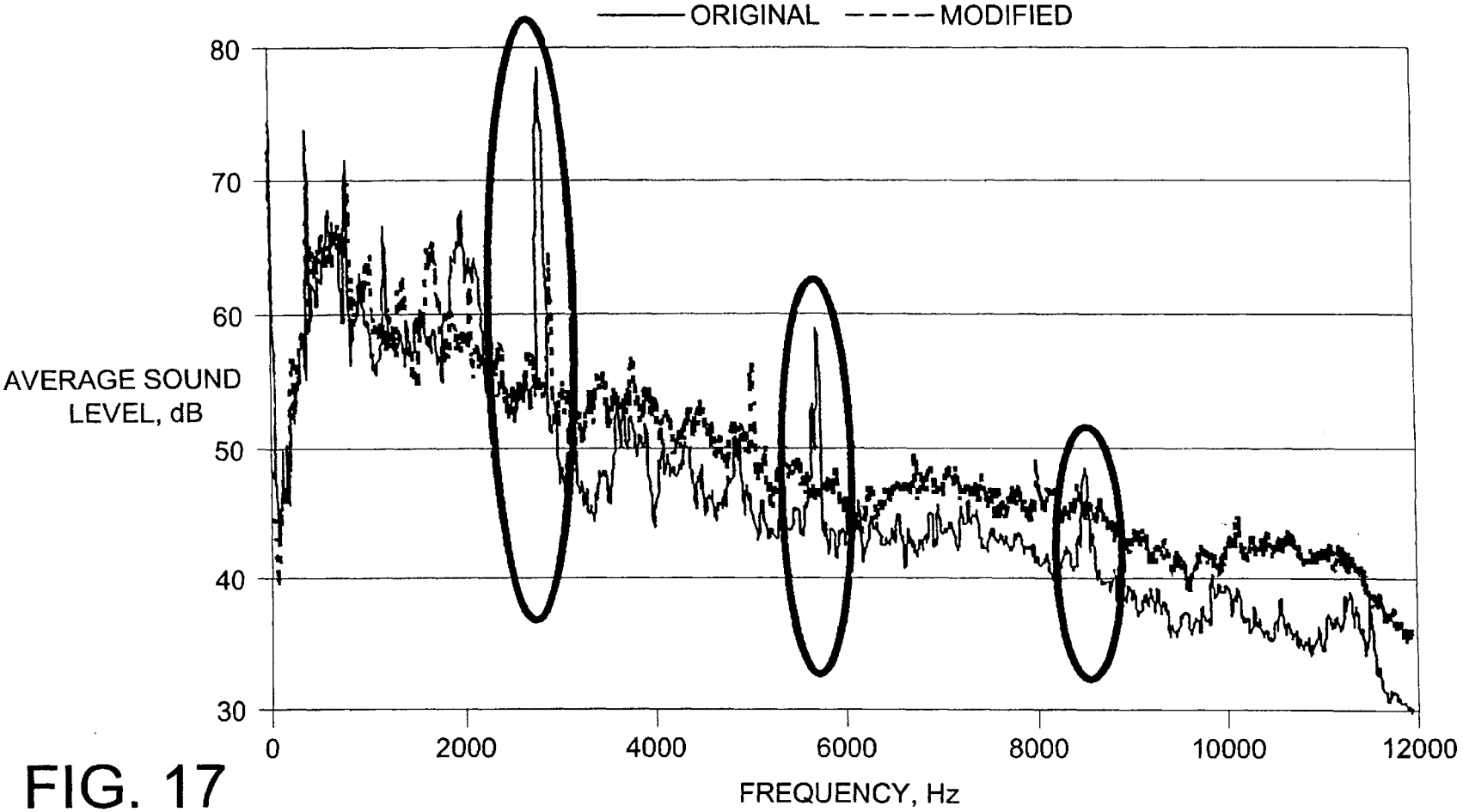
FIG. 17 is a chart comparing average sound level and frequency for the prototype (modified) impeller assembly of FIG. 13 and the original (unmodified) impeller assembly of FIG. 12.

Referring to FIG. 17, sound power measurements were made with the prototype impeller assembly of FIG. 13 and an unmodified impeller assembly of the type shown in FIG. 12. The average sound level is compared to the frequency in FIG. 17. The most significant aspect of the data is that the tone noise at approximately 3,000 Hz is reduced by 15 dB and its harmonics are reduced to levels below the broadband noise levels, as shown within the three circled areas of the plot. The overall noise level was reduced by 3.3 dBA and 36.8 sones, despite the increase in the high frequency noise in the modified unit.

Figure 18:
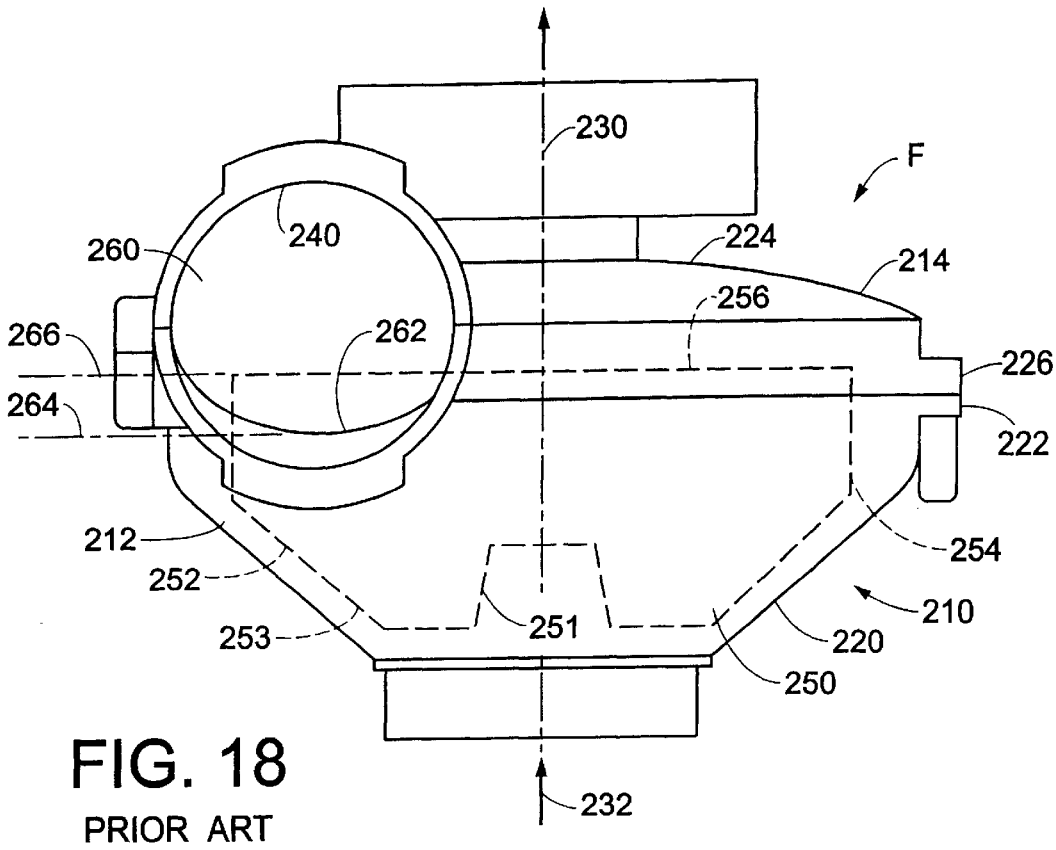
FIG. 18 PRIOR ART
FIG. 18 is a schematic side elevational view of an impeller housing according to an existing design.

Another prior art impeller and housing assembly F is shown in FIG. 18. The prior art impeller and housing assembly comprises a housing 210. The housing 210 comprises a first section 212 and a second section 214 which are connected to each other. First section 212 comprises a first wall 220 and a second wall 222. Second section 214 comprises a first wall 224 and a second wall 226. The first section and second section are connected together at the second walls 222 and 226. The impeller housing further comprises a rotational or central axis 230. An inlet port 232 is located along the central axis 230. An outlet port 240 is located on a second axis spaced from, and approximately normal to, the central axis 230.

An impeller 250 is mounted within the housing. The impeller 250 comprises at least one blade 252 with a leading edge 251, a top edge 253, a trailing edge 254 and a distal surface 256. The impeller 250 creates an airflow drawing air through the inlet port 232. The airflow passes through the blades 252 and past the trailing edge 254 of the blades. The airflow is expelled through the outlet port 240.

The outlet port 240 communicates with an exhaust passage 260 which has a path with an edge 262. As seen in FIG. 18, the edge 262 extends below the distal surface 256 of the impeller blade 252. A plane 264 is tangent to the edge 262. A second plane 266 is parallel to and spaced from the first plane 264. The second plane 266 contacts the distal surface 256 of the blade 252. The second plane 266 extends into the outlet port 240 such that the blade distal surface 256 is positioned above the edge 262 of the outlet port 240. That is, the blade distal surface can be seen when looking from the outlet port 240 into the housing 210. Thus, since the blade can be seen from the outlet port opening, airflow passes from the end of the blade through a discontinuity formed at the junction of the outlet port and the walls of the housing. The airflow is then chopped by the discontinuity at the rate that the blades pass the discontinuity, thus causing noise.

Figure 19:
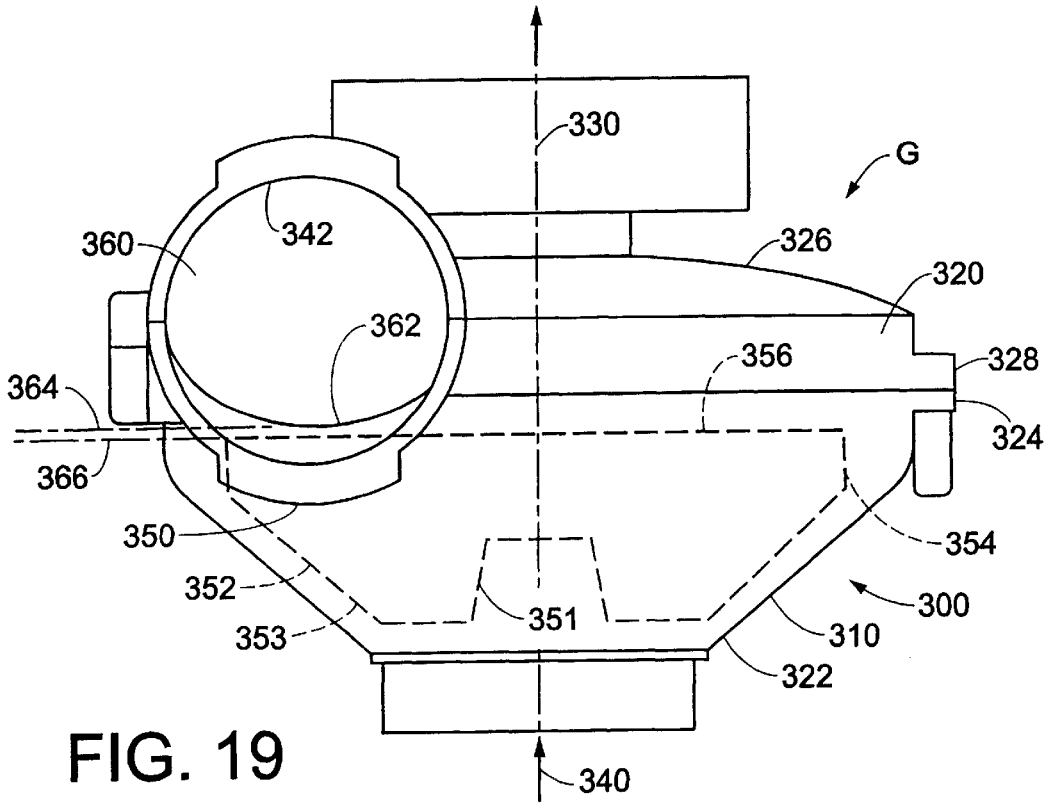
FIG. 19 is a schematic side elevational view of an impeller housing according to a fourth preferred embodiment of the present invention.

With reference now to FIG. 19, an impeller and housing assembly G with an improved housing according to a fourth preferred embodiment is there shown. The impeller assembly comprises a housing 300. The housing 300 comprises a first section 310 and a second section 320 which are connected to each other. First section 310 comprises a first wall 322 and a second wall 324. Second section 320 comprises a first wall 326 and a second wall 328. The first section and second section are connected together at the second walls 324 and 328. The impeller housing further comprises a central axis 330. An inlet port 340 is located along the central axis 330. An outlet port 342 is located on a second axis spaced from, and approximately normal to, the central axis 330.

An impeller 350 is mounted within the housing. The impeller comprises at least one blade 352 with a leading edge 351, a top edge 353, a trailing edge 354 and a distal surface 356. The impeller creates an airflow drawing air through the blades 352 and past the trailing edge 354 of the blades. The airflow is expelled through the outlet port 342.

The outlet port 342 communicates with an exhaust passage 360 which has a path with an edge 362. As seen in FIG. 19, the edge 362 is spaced from the distal edge 356 of the impeller blade 352. A plane 364 contacts the edge 362 of the exhaust passage 360. A second plane 366 is parallel to and spaced from the first plane 364. The second plane 366 contacts the distal surface 356 of the blade 352. The second plane 366 is positioned below the edge 362 of the outlet port 342. Since the distal edge 356 of the blade is spaced from the outlet port 342 (i.e., the blade cannot be seen from the outlet port), there is no discontinuity between the impeller housing and the outlet port.

Figure 20:
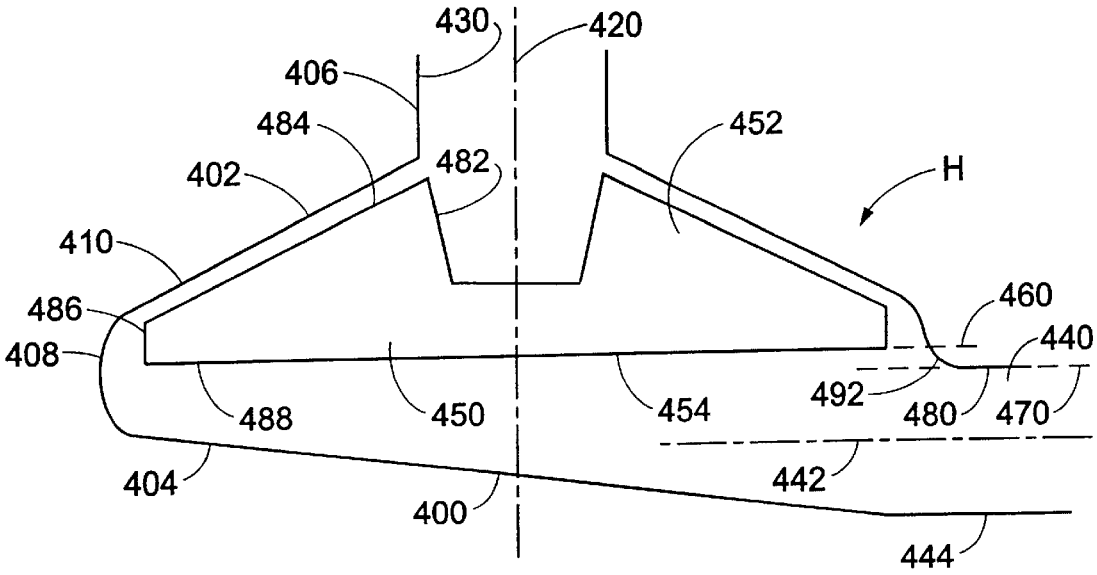
FIG. 20 is a schematic side elevational view in cross-section of an impeller housing in accordance with a fifth preferred embodiment of the present invention.

With reference now to FIG. 20, an impeller and housing assembly H with an improved impeller housing according to a fifth preferred embodiment of the present invention is shown. The impeller assembly comprises a housing 400. The housing 400 comprises a first wall 402, a second wall 404, a third wall 406 and a curved side wall 408. The curved side wall 408 connects the first wall 402 to the second wall 404. The third wall 406 extends away from the first wall 402. The first wall 402 forms a volute 410.

The impeller housing also comprises a central axis 420. An inlet port 430 is located along the central axis 420. The third wall 406 forms the inlet passage and defines the inlet port 430.

An outlet port 440 is located on a second axis 442 spaced from and approximately normal to the central axis 420. An exhaust passage 444 extends away from the outlet port 440. If desired, the exhaust passage 444 can increase in diameter along its length. The exhaust passage 444 can be enlarged to handle an increased air flow.

An impeller 450 is mounted within the housing about the central axis 420 for rotation. The impeller 450 comprises at least one blade 452. Preferably, a plurality of blades are used. Each blade 452 has a distal surface 454.

The volute 410 can have a uniform cross section. Each blade 452 is enclosed within the cross section of the volute 410. The uniform cross section of the volute 410 helps to reduce noise by eliminating discontinuity along the blade length.

A first plane 460 contacts the blade distal surface 454. The first plane is approximately perpendicular to the central axis 420 and parallel to the second axis 442. A second plane 470 is parallel to and spaced from the first plane 460. The second plane 470 contacts a wall 480 of the outlet port 440 at a location which is closest to the first plane 460.

The blade 452 comprises a leading edge 482, a top edge 484, and a trailing edge 486. A backplate 488, which supports the blade 452, is positioned along the first plane 460.

Preferably, the top edge 484 of the impeller is generally parallel to the volute 410 of the impeller housing. The area between them is preferably minimized to further reduce noise.

The impeller 450 creates an air flow drawing air through the inlet port 430. The airflow passes by the leading edge 482, and between the blades 452 past the trailing edge 486 of the blades. The airflow then is expelled through the outlet port 440 and into the exhaust passage 442 during rotation of the impeller 450.

The housing 400 also comprises a curved spacer wall 492 which is positioned between the volute 410 and the wall 480 of the outlet port 440. The spacer wall 492 spaces the trailing edge 486 of each blade 452 from the outlet port 440 and helps eliminate any discontinuity between the volute 410 and the outlet port 440.

Figure 21:
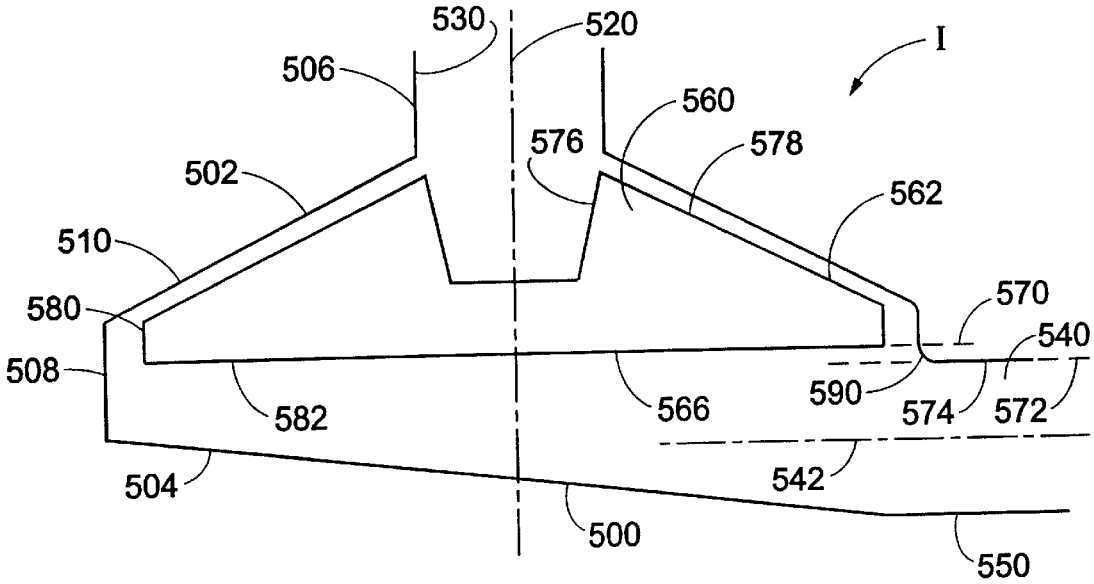
FIG. 21 is a schematic side elevational view in cross-section of an impeller housing in accordance with a sixth preferred embodiment of the present invention.

With reference now to FIG. 21, another impeller and housing assembly I with an improved impeller housing according to a sixth preferred embodiment is there shown. The impeller assembly comprises a housing 500. The housing 500 comprises a first wall 502, a second wall 504, a third wall 506 and a side wall 508. The side wall 508 connects the first wall 502 to the second wall 504. The third wall 506 extends away from the first wall 502. The first wall 502 forms a volute 510.

The impeller housing also comprises a central axis 520. An inlet port 530 is located along the central axis 510. The third wall 506 forms the inlet passage and defines the inlet port 530.

An outlet port 540 is located on a second axis 542 spaced from and approximately normal to the central axis 520. An exhaust passage 550 extends away from the outlet port 540. If desired, the exhaust passage 550 can increase in diameter along its length. The exhaust passage 550 can be enlarged to handle an increased air flow.

An impeller 560 is mounted within the housing. The impeller 560 comprises at least one blade 562. Preferably, a plurality of blades are used. Each blade 562 has a distal surface 566.

The volute 510 can have a uniform cross section. Each blade 562 is enclosed within the cross section of the volute 510. The uniform cross section of the volute 510 helps to reduce noise by eliminating discontinuity along the blade length.

The impeller assembly further comprises a first plane 570 which is approximately perpendicular to the central axis 520. The first plane 570 contacts the blade distal surface 566.

The impeller assembly also comprises a second plane 572 which is parallel to and spaced from the first plane 570. The second plane 572 contacts a wall 574 of the outlet port 540 at a location which is closest to the first plane 570.

The blade 562 comprises a leading edge 576, a top edge 578, and a trailing edge 580. A backplate 582, which supports the blade 562, is positioned along the first plane 570 and forms the distal surface 566.

Preferably, the top edge 578 of the impeller is generally parallel to the volute 510 of the impeller housing. The area between them is preferably minimized to further reduce noise.

The impeller 560 creates an air flow drawing air through the inlet port 530. The airflow passes by the leading edge 576, and between the blades 562 past the trailing edge 580 of the blades. The airflow then is expelled through the outlet port 540 and into the exhaust passage 550 during rotation of the impeller 560.

The impeller assembly also comprises a spacer wall 590 which is positioned between the volute 510 and the wall 574 of the outlet port 540. The spacer wall 590 spaces the distal surface 566 of each blade 562 from the outlet port 540 and helps eliminate any discontinuity between the volute 510 and the outlet port 540.

Figure 22:
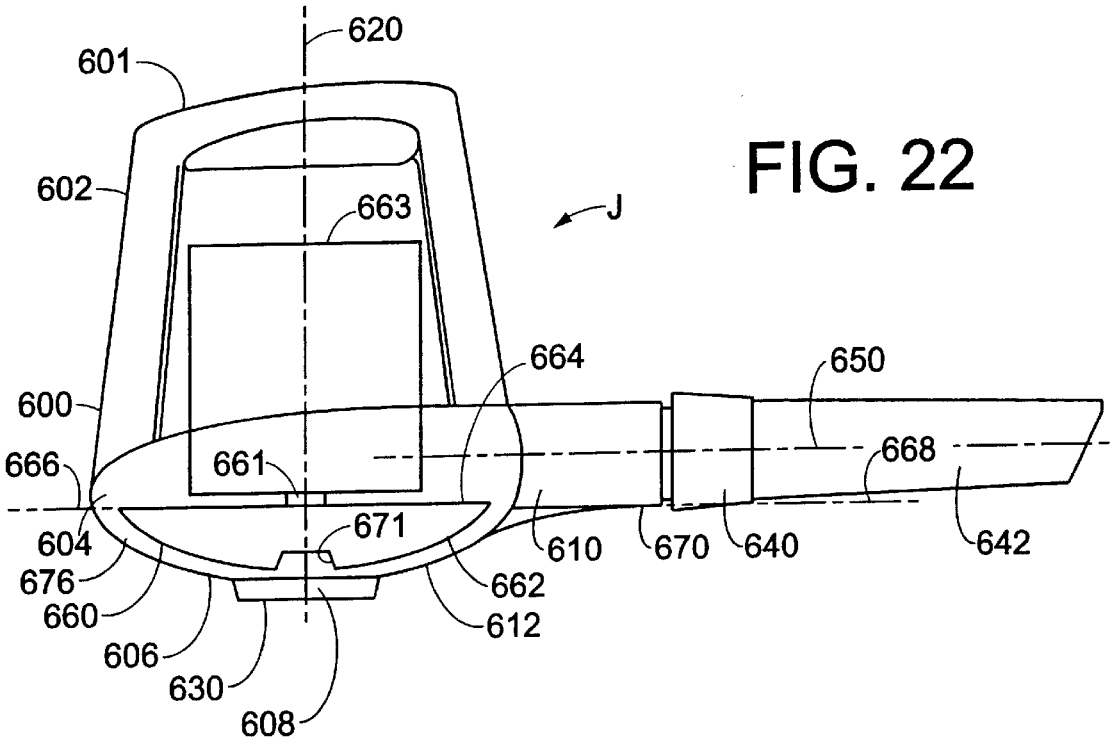
FIG. 22 is a schematic side elevational view in cross-section of a blower housing in accordance with a seventh embodiment of the present invention.

With reference now to FIG. 22, a seventh preferred embodiment J of the present invention is there shown. The seventh preferred embodiment is a leaf blower or vacuum. Alternatively, the blower could be used for blowing debris, dust, etc. The blower assembly comprises a housing 600. The housing 600 comprises a first wall 601, a second wall 602, a third wall 604, a fourth wall 606, a fifth wall 608 and a sixth wall 610. The fifth wall 608 extends away from the fourth wall 606. The fourth wall 606 forms a volute 612.

The blower housing also comprises a central axis 620. An inlet port 630 is located along the central axis 620. The fourth wall 608 forms the inlet passage and defines the inlet port 630.

An outlet port 640 is located on a second axis 650 spaced from and approximately normal to the central axis 620. The outlet port 640 can be of a circular cross section. The outlet port 640 is connected to a nozzle 642 through which air flows.

An impeller 660 is located within the volute 612. The impeller 660 is mounted on a shaft 661 which is located along the central axis 620. The impeller comprises at least one blade 662. Preferably, a plurality of blades are used. The shaft 661 connects the impeller to a motor 663. Each blade 662 has a distal surface 664.

The volute 612 preferably has a uniform cross section. Each blade 662 is enclosed within the cross section of the volute 612. The uniform cross section of the volute 612 helps to reduce noise by eliminating discontinuity along the blade length. A first plane 666 is approximately perpendicular to the central axis 620. The first plane 666 contacts the blade distal surface 664. A second plane 668 is parallel to and spaced from the first plane 666. The second plane 668 contacts a wall 670 of the outlet port 640 at a location which is closest to the first plane 666. It is apparent that these planes are spaced from each other for the reasons outlined above.

Figure 23:
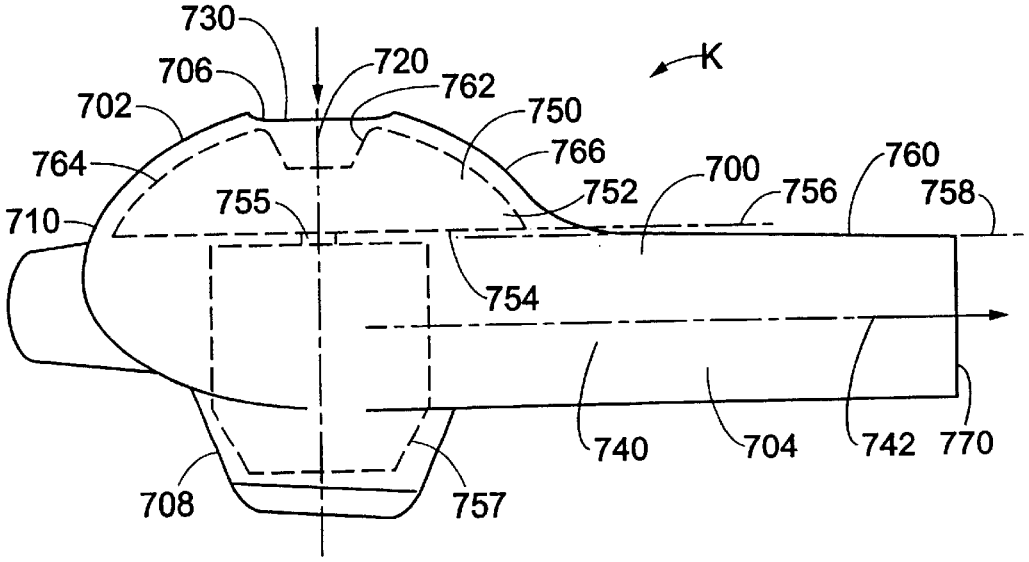
FIG. 23 is a schematic side elevational view of a hair dryer housing in accordance with an eighth embodiment of the present invention.

With reference now to FIG. 23, an eighth preferred embodiment K of the present invention is there shown. The eighth preferred embodiment is a hair dryer or blower. The hair dryer assembly comprises a housing 700. The housing 700 comprises a first wall 702, a second wall 704, a third wall 706 and a fourth wall 708. The fourth wall 708 extends away from the second wall 704. The first wall 702 forms a volute 710.

The impeller housing also comprises a central axis 720. An inlet port 730 is located along the central axis 710. The third wall 706 forms the inlet passage and defines the inlet port 730.

An outlet port 740 is located on a second axis 742 spaced from and approximately normal to the central axis 720.

An impeller 750, which is located within the housing 700, comprises at least one blade 752. Preferably, a plurality of blades are used. Each blade 752 has a distal surface 754. The impeller 750 is mounted on a shaft 755 which is positioned along the central axis 720. The shaft 755 connects the impeller 750 to a motor 757.

A first plane 756 is approximately perpendicular to the central axis 720. The first plane 756 contacts the blade distal surface 754. A second plane 758 is parallel to and spaced from the first plane 756. The second plane 758 contacts a wall 760 of the outlet port 740 at a location which is closest to the first plane 756. The two planes are spaced from each other each other for the reasons mentioned above.

Figure 24:
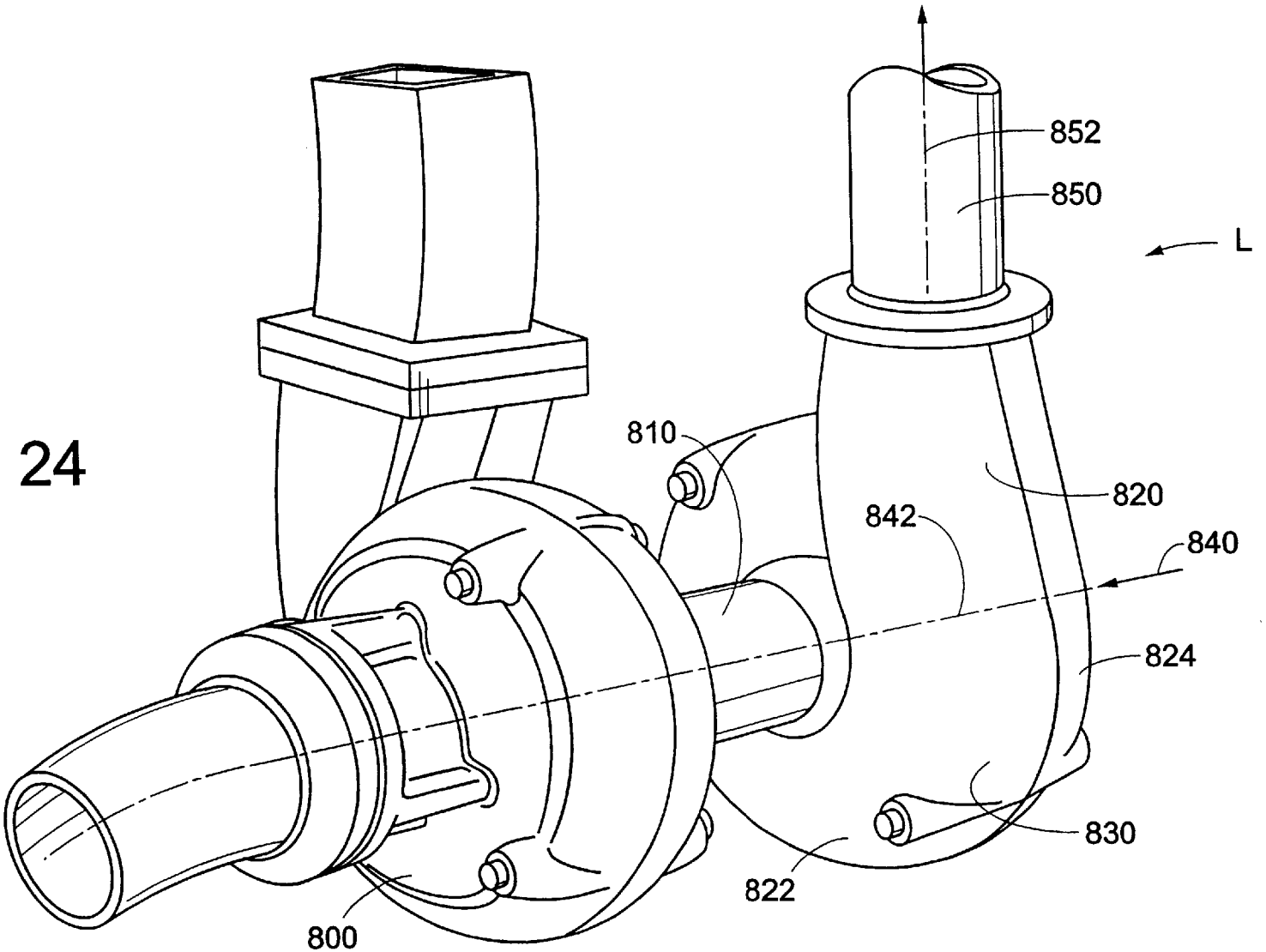
FIG. 24 is a perspective view of an HVAC system housing in accordance with a ninth embodiment of the present invention.

With reference now to FIG. 24, a ninth preferred embodiment L of the present invention is shown. The ninth preferred embodiment is a HVAC (Heating, Ventilation, and Air Conditioning) system. The HVAC system comprises a housing 800 for a turbine (not shown). The turbine is used to drive an impeller (not shown). A second housing 810 is used to house a shaft which couples the turbine to the impeller. A third housing 820 comprises a first wall 822 and a second wall 824 secured to each other to form a volute 830.

An inlet port 840 is located along a central axis 842. An outlet port 850 is located on a second axis 852 spaced from and approximately normal to the central axis 842.

An impeller (not shown), which is located within the housing 820 and rotates about a central or rotational axis 842, comprises at least one blade. As in the previous embodiments, a distal edge of the impeller is spaced from the outlet port such that a plane extends between the distal edge of the impeller and the outlet port. The entirety of the outlet port lies on one side of the plane and the distal edge of the impeller lies on another side of the plane.

Two additional embodiments, which are not illustrated, include a fan system in convection ovens and fans used for stove top vents. The description of these embodiments is the same as described above for the other discussed embodiments.

The invention has been described with reference to several preferred embodiments. Obviously, alterations and modifications will occur to others upon a reading and understanding of this specification. It is intended to include all such modifications and alterations insofar as they come within the scope of the appended claims or the equivalents thereof.

Having thus described the preferred embodiments, the invention is now claimed to be:

1. An impeller and housing assembly, comprising:
- a shaft;
- a housing comprising:
  - a plurality of walls, wherein one of said walls comprises a volute,
  - a first axis,
  - an inlet port aligned with said first axis,
  - wherein said shaft is oriented parallel to said first axis,
  - an outlet port located on a second axis spaced from said first axis, and
  - an exhaust passage which extends from said outlet port;
- an impeller mounted on said shaft for rotation, said impeller being located in said housing between said inlet port and said outlet port and comprising:
  - a hub, and
  - at least one blade extending from said hub,
  - wherein said at least one blade is located entirely on a first side of a plane approximately parallel to said second axis and any discontinuity in said housing is entirely located on a second side of said plane, said housing having an airflow path free of airflow chopping discontinuities between the impeller and the outlet port.

2. The impeller and housing assembly of claim 1, wherein said plurality of walls comprises a first wall, a second wall, a side wall connecting said first wall to said second wall, and a third wall extending from said first wall, said third wall forming an inlet passage extending from said inlet port.

3. The impeller and housing assembly of claim 1, wherein said exhaust passage increases in diameter along its length.

4. The impeller and housing assembly of claim 1, wherein said outlet port is approximately circular.

5. The impeller and housing assembly of claim 1, wherein said at least one blade comprises a leading edge, a top edge and a trailing edge.

6. The impeller and housing assembly of claim 5, wherein said impeller further comprises a backplate which supports said at least one blade, said backplate being positioned adjacent said plane.

7. The impeller and housing assembly of claim 1 further comprising a spacing wall which is positioned between the volute and said outlet port wherein the spacing wall spaces said at least one blade from said outlet port.

8. The impeller and housing assembly of claim 1, wherein a top surface of the impeller is generally parallel to a top surface of the housing and the area between the top surface of the impeller and the top surface of the housing is minimized to reduce noise.

9. An impeller and housing assembly comprising:
- a shaft;
- a two-piece housing comprising:
  - a central axis,
  - a first section comprising at least one flange,
  - a second section comprising at least one flange,
  - said at least one flange of said first section and said at least one flange of said second flange being connected for holding said first section and said second section together,
  - at least one wall comprising a volute,
  - an inlet port aligned with said central axis, wherein said shaft is oriented parallel to said central axis, an outlet port spaced from said inlet port, one or more discontinuities, an exhaust passage which extends from said outlet port, wherein said exhaust passage and said outlet port are located along a port axis approximately perpendicular to said central axis; and, an impeller mounted on said shaft for rotation, said impeller being located in said housing and comprising:

a hub, and at least one blade extending from said hub, wherein said impeller creates an air flow drawing air through the inlet port and expelling the air into the outlet port during rotation of said impeller, wherein said at least one blade has a distal edge contacting one side of a plane which is approximately parallel to said port axis and said outlet port and all of said one or more discontinuities lie entirely on another side of said plane, said housing having an airflow path free of airflow chopping discontinuities between the impeller and the outlet port.

10. The impeller and housing assembly of claim 9, wherein said second section comprises:

at least one wall; and said outlet port.

11. The impeller and housing assembly of claim 9, wherein said first section comprises:

said at least one wall comprising a volute; and said inlet port.

12. The impeller and housing assembly of claim 11, further comprising a spacing wall which is positioned between the volute and the exhaust passage wherein the spacing wall spaces the at least one blade from the outlet port.

13. The impeller and housing assembly of claim 12, wherein said volute has a uniform cross section and said at least one blade is enclosed within said cross section of said volute.

14. The impeller and housing assembly of claim 9, wherein said at least one blade comprises a leading edge, a top edge and a trailing edge.

15. The impeller and housing assembly of claim 14, wherein said impeller further comprises a backplate which supports said at least one blade, wherein said backplate comprises said distal edge.

16. An impeller and housing assembly for reduced noise and improved airflow comprising:

a shaft;

a housing comprising:

a plurality of walls, wherein one of said plurality of walls comprises a volute, a central axis, wherein said shaft extends along said central axis, an inlet port located on said central axis, an outlet port spaced from and oriented approximately perpendicular to said central axis, and an exhaust passage which extends from said outlet port;

an impeller mounted on said shaft for rotation and located in said housing adjacent said inlet port, said impeller comprising:

a hub, at least one blade extending from said hub, a backplate which supports said at least one blade, wherein said impeller creates an airflow drawing air through the inlet port and expelling the air into the outlet port during rotation of said impeller; and said housing further comprising a spacer wall which is positioned between the volute and the outlet port, wherein the spacer wall spaces the at least one blade from any discontinuity in the housing thus reducing noise and improving airflow, said housing having an airflow path free of airflow chopping discontinuities between the impeller and the outlet port.

17. The impeller and housing assembly of claim 16, wherein said plurality of walls comprises a first wall, a second wall, a side wall connecting said first wall to said second wall, and a third wall extending from said first wall, which forms an inlet passage extending from said inlet port.

18. The impeller and housing assembly of claim 16, wherein said at least one blade comprises a leading edge, a top edge and a trailing edge.

19. The impeller and housing assembly of claim 16, wherein said volute has a uniform cross section and said at least one blade is enclosed within said cross section of said volute.

20. The impeller and housing assembly of claim 16, wherein said exhaust passage increases in diameter along its length.

21. The impeller and housing assembly of claim 16, wherein said outlet port is of a circular cross section.

22. In combination:

a housing including a plurality of walls surrounding a volume, at least one of said walls defining a volute;

an inlet port formed through said housing and opening into said volume;

an outlet port formed through said housing and opening into said volume; and an impeller mounted for rotation in said housing about a rotational axis and spaced from any discontinuities of the housing, whereby air leaving a blade of the impeller is not directed at a discontinuity of the housing, said impeller including a furthest downstream surface relative to the inlet port and a plane contacting said furthest downstream surface, said outlet port and said impeller being disposed on opposite sides of said plane.

23. The combination of claim 22, wherein said plurality of walls comprises a first wall, a second wall, a side wall connecting said first wall to said second wall, and a third wall extending from said first wall, said third wall forming an inlet passage extending from said inlet port.

24. The combination of claim 22, further comprising an exhaust passage extending from said outlet port, said exhaust passage increases in diameter along its length.

25. The combination of claim 22, wherein said outlet port has a circular cross-section.

26. The combination of claim 22, wherein said impeller comprises a hub and a blade extending from said hub, said blade comprises a leading edge, a top edge and a trailing edge.

27. The combination of claim 22, wherein said rotational axis is a central axis of said housing.

28. The combination of claim 27 further comprising a shaft mounted along said central axis, wherein said shaft extends into said housing, and wherein said impeller is mounted on said shaft.

29. The combination of claim 26 further comprising a spacing wall which is positioned between said volute and said outlet port wherein the spacing wall spaces said at least one blade from the outlet port.

* * * * *